United States Patent [19]

Seidel et al.

[11] Patent Number: 4,712,849

[45] Date of Patent: Dec. 15, 1987

[54] DEVICE CONNECTING THE SHIELDING OF PLUGS TO A SUBRACK GROUND

[75] Inventors: Peter Seidel, Groebenzell; Leo Pelzl, Holzkirchen; Karl Zell, Niederpoecking, all of Fed. Rep. of Germany

[73] Assignee: Siemens Aktiengesellschaft, Berlin and Munich, Fed. Rep. of Germany

[21] Appl. No.: 874,862

[22] Filed: Jun. 16, 1986

[30] Foreign Application Priority Data

Jul. 10, 1985 [DE] Fed. Rep. of Germany ..... 3524670

[51] Int. Cl.[4] ..... H01R 13/648

[52] U.S. Cl. ..... 439/607

[58] Field of Search ..... 339/14 P, 14 R, 147 R, 339/143 R, 252 R

[56] References Cited

U.S. PATENT DOCUMENTS

| | | | |
|---|---|---|---|
| 3,418,621 | 12/1968 | Campbell, Jr. | 339/143 R |
| 3,430,183 | 2/1969 | Feeser et al. | 339/143 R |
| 4,519,665 | 5/1985 | Althouse et al. | 339/143 R |

FOREIGN PATENT DOCUMENTS

| | | | |
|---|---|---|---|
| 73957 | 3/1983 | European Pat. Off. | 339/143 R |
| 2740684 | 7/1979 | Fed. Rep. of Germany | 339/14 R |
| 2909627 | 9/1980 | Fed. Rep. of Germany | 339/143 R |
| 2517482 | 6/1983 | France | 339/143 R |
| 17736 | 10/1971 | Japan | 339/143 R |
| 2098412 | 11/1982 | United Kingdom | 339/143 R |
| 2120467 | 11/1983 | United Kingdom | 339/143 R |
| 2122038 | 1/1984 | United Kingdom | 339/143 R |

OTHER PUBLICATIONS

IBM Technical Disclosure Bulletin, vol. 23, No. 9, Feb. 1981, pp. 4242–4243.

*Primary Examiner*—William R. Briggs

*Attorney, Agent, or Firm*—Hill, Van Santen, Steadman & Simpson

[57] ABSTRACT

During plugging of a plug, plug strips of the plug partially immerse into passages of a centering strip. A metallic, electrically conductive layer is applied to the lateral faces of these passages and the shielding of the plug is provided such with spring elements that the latter press resiliently against the metallic layer in the plugged condition of the plug. Means are also provided which electrically connect to metallic layer of the individual passages to one another and to the grounded potential layer of a subrack.

10 Claims, 1 Drawing Figure

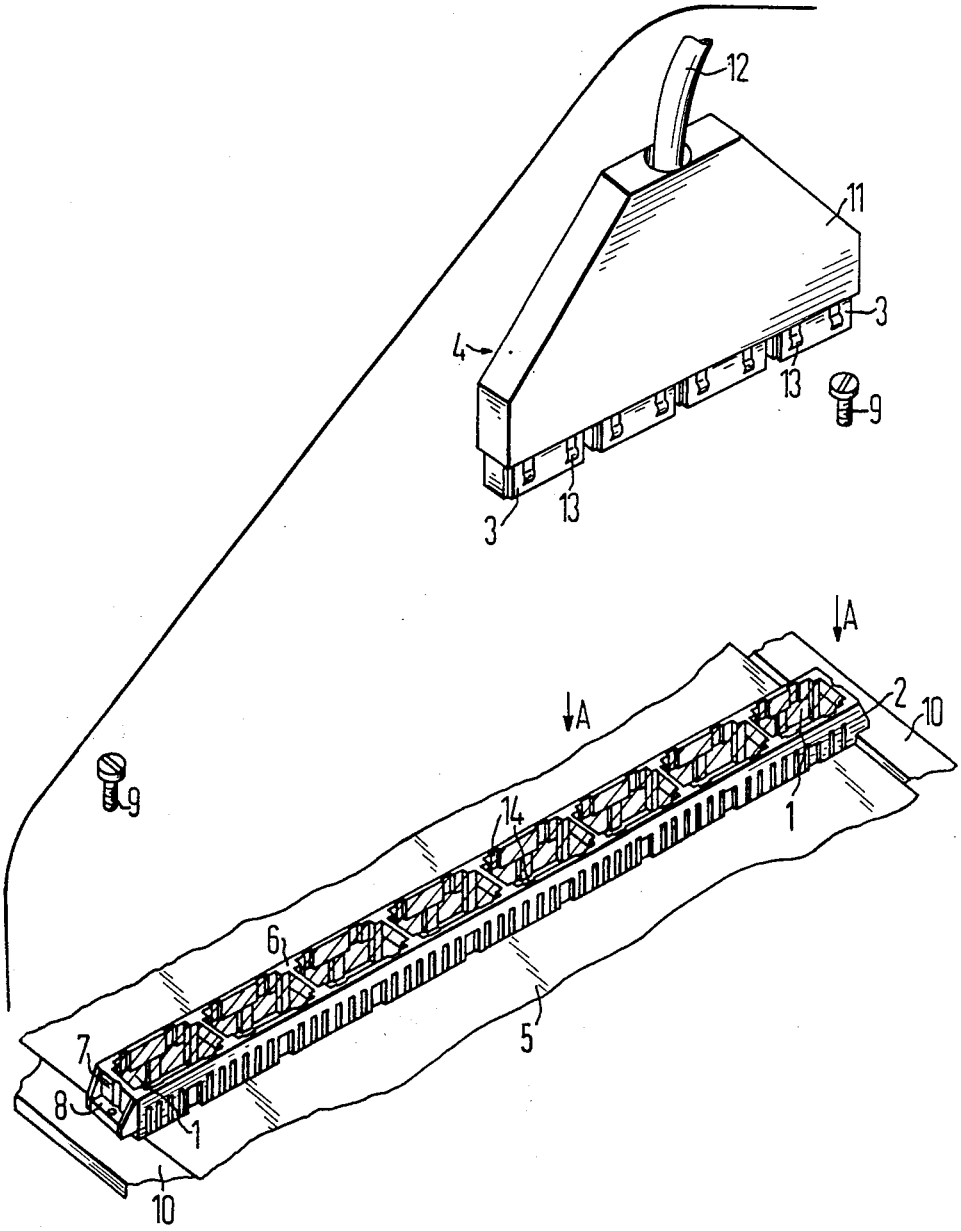
12
11
3
4
13
9
3
13
A
A
2
10
9
14
1
6
5
7
8
1
10

DEVICE CONNECTING THE SHIELDING OF PLUGS TO A SUBRACK GROUND

BACKGROUND OF THE INVENTION

1. Field of the Invention

The invention relates to a mechanism for connecting the shielding of a plug of a multi-pole plug connector to the grounded potential layer of a subrack wherein the plug partially extends into passages of a centering strip during the plugging operation.

2. Description of the Prior Art

German Pat. No. 27 40 684 discloses that the shielding of a switch or switched cable is secured on the carrier plate of a module and is electrically connected to the grounded potential layer of a subrack via contact elements during insertion of the cable plug. The contact elements are designed as contact springs at the subrack. The shielding caps are provided with suitable contact surfaces against which the contact springs press in the plugged condition of the plug and thus electrically connect the shielding caps to the grounded potential layer. The increased signal processing speeds and, thus, higher noise fields of the signal lines, as well as the growing number of poles of the plug connectors require an incorporation of the centering strip existing in the plug mechanism into the shielding concept.

SUMMARY OF THE INVENTION

An object of the invention is to design the multi-pole plug connector such that the centering strip is also included in the shielding concept of the plug connector when the plug is connected to the grounded potential layer of the subrack. The advantage of the invention is particularly provided by the connection of the grounded potential layer of the subrack and the shielding of the regions of the centering strip in which the signal lines are conducted by means of a single device which, moreover, also makes use of only an extremely small mounting space.

A development of the invention provides that the spring elements are arranged at metallic shielding caps of the plug. The spring elements can be both applied to the shielding of the plug by means of fastening elements as well as fashioned at the shielding.

A further advantageous embodiment provides spring elements at metallic shielding elements which are located in the interior of a plastic cap of the plug. The metallic shielding element at which the spring elements are fashioned can be adapted to nearly all designs of the interior of the plastic cap, whereby the required shielding effect can be achieved by means of shielding surfaces of different sizes.

BRIEF DESCRIPTION OF THE DRAWINGS

An exemplary embodiment of the invention shall be set forth below with reference to the drawing. The FIGURE is an exploded perspective view of a centering strip provided with a plurality of passages.

DESCRIPTION OF THE PREFERRED EMBODIMENTS

As seen in the FIGURE, a centering strip 2 is provided with a plurality of passages 1. Several plug strips 3 of a plug 4 dip nearly entirely into these passages 1 during plugging in direction A. That region of the passages 1 of the centering strip 2 lying opposite the plug strips 3 is provided with openings (not shown) which serve for the passage of cooperating contact elements (likewise not shown) of the plug mechanism which are arranged on a motherboard 5. The lateral surfaces of the passages 1 are provided with a metallic, electrically conductive layer which is identified by a 45° hatching in the FIGURE. An outside surface 6 facing the plug 4 as well as the end faces 7 and the outsides of a fastening device 8 of the centering strip 2 likewise comprise a metallic layer. This layer connects the metallic layers of the passages 1 to one another and produces the electrical connection to the grounded potential layer of a subrack 10 via metallic fastening screws 9. The plug 4 is provided with a metallic shielding cap 11 which nearly completely surrounds the individual, unshielded switch wires of a switch cable 12 that is electrically connected to the plug strip 3. Metallic spring elements 13 are attached such to the edges of the shielding cap 11 directed toward the plug strip 3 that these spring elements 13 partially engage into recesses 14 of the centering strip 2 situated at the longitudinal side faces of the passages 1, engaging partially thereinto in the plugged condition of the plug 4 and pressing resiliently against the metallic layer of the passages 1. The ends of the spring elements 13 pointing toward the centering strip 2 are arcuately shaped. Instead of the metallic shielding cap 11, the plug 4 can be equipped with a plastic cap (not shown). In this case, the spring elements 13 are arranged as metallic shielding elements (not shown) which are located in the inside of the plastic cap.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A mechanism for connecting the shielding of a plug of a multi-pole plug connector to the grounded potential layer of a subrack, whereby the plug partially immerses into a plurality of individual passages of a centering strip during the plugging operation, comprising: a metallic, electrically conductive layer being applied to the lateral faces of said passages; said shielding of the multi-pole plug being provided with a plurality of spring elements which resiliently press against said metallic layer of the lateral faces in the plugged condition of the plug said spring elements being received in recesses in the lateral faces of said passages; and means electrically connecting the metallic layer of the individual passages to one another and to the grounded potential layer of the subrack.

2. A mechanism according to claim 1, wherein said spring elements are arranged on a metallic shielding cap of said plug.

3. A mechanism according to claim 1, wherein said spring elements are attached to metallic shielding elements that are located in the inside of a plastic cap of the plug.

4. A mechanism according to claim 1, wherein said means that electrically connects the metallic layer of the individual passages to one another and to the grounded potential layer of the subrack is composed of layers applied by electro deposition.

5. A mechanism according to claim 1, wherein said means that electrically connects the metallic layer of the individual passages to one another and to the grounded potential layer of the subrack is composed of layers applied by sputtering.

6. A mechanism according to claim 1, wherein said means that electrically connects the metallic layer of the individual passages to one another and to the grounded potential layer of the subrack is composed of a metallic adhesive foil.

7. A mechanism according to claim 1, wherein said means that electrically connects the metallic layer of the individual passages to one another and to the grounded potential layer of the subrack are composed of shaped connecting sheets.

8. A mechanism according to claim 1, wherein the means which connect the metallic layer of the passages to grounded potential of the subrack are arranged in the regions of fastening devices of the centering strip and, after the centering strip has been fastened to the subrack, these means lie directly against the subrack.

9. A mechanism according to claim 1, wherein the means which connect the metallic layer of the passages to grounded potential of the subrack are arranged in the regions of fastening devices of the centering strip and, after the centering strip has been fastened to the subrack, these means lie against metallic fastening means.

10. A mechanism according to claim 1, wherein the metallic layer in the passages of the centering strip is applied in at least those regions against which the spring elements press.

* * * * *